US011385572B2

(12) United States Patent
Berger et al.

(10) Patent No.: US 11,385,572 B2
(45) Date of Patent: Jul. 12, 2022

(54) APPLYING FORCE TO PRINT AGENT

(71) Applicant: HP Indigo B.V., Amstelveen (NL)

(72) Inventors: Shachar Berger, Ness Ziona (IL); Alon Froom, Ness Ziona (IL); Sagie Shanun, Ness Ziona (IL); Oran Levintant, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 156 days.

(21) Appl. No.: 16/606,309

(22) PCT Filed: Sep. 21, 2017

(86) PCT No.: PCT/EP2017/073912

§ 371 (c)(1),
(2) Date: Oct. 18, 2019

(87) PCT Pub. No.: WO2019/057283

PCT Pub. Date: Mar. 28, 2019

(65) Prior Publication Data

US 2021/0364952 A1 Nov. 25, 2021

(51) Int. Cl.
*G03G 15/10* (2006.01)

(52) U.S. Cl.
CPC ..... *G03G 15/104* (2013.01)

(58) Field of Classification Search
CPC ..... G03G 15/104
See application file for complete search history.

(56) References Cited

U.S. PATENT DOCUMENTS

| | | | | |
|---|---|---|---|---|
| 8,693,908 | B2 | 4/2014 | Nishiyama et al. | |
| 9,250,572 | B2 | 2/2016 | Karp et al. | |
| 2006/0210315 | A1 | 9/2006 | Nakamura et al. | |
| 2011/0293335 | A1* | 12/2011 | Takahashi | G03G 15/104 399/281 |
| 2015/0078784 | A1* | 3/2015 | Maeyama | G03G 15/104 399/237 |
| 2016/0043382 | A1 | 2/2016 | Tanihara et al. | |

FOREIGN PATENT DOCUMENTS

| | | | |
|---|---|---|---|
| EP | 2685320 | A1 | 1/2014 |
| GB | 2235820 | A | 3/1991 |
| JP | 08146741 | | 6/1996 |
| JP | 2006099022 | * | 4/2006 |
| JP | 2006099022 | A | 4/2006 |
| WO | WO-2017030580 | A1 | 2/2017 |

* cited by examiner

*Primary Examiner* — Sandra Brase
(74) *Attorney, Agent, or Firm* — Dicke Billig & Czaja PLLC

(57) ABSTRACT

A print agent application assembly includes a print agent transfer roller to receive print agent and transfer a portion of the print agent to a photoconductive surface. The assembly may also include a print agent regulator roller to regulate a film thickness of print agent on the print agent transfer roller. The assembly may also include a mechanism to generate an oscillating force to be applied to print agent on the print agent transfer roller. A method and a print apparatus are also disclosed.

20 Claims, 4 Drawing Sheets

APPLYING FORCE TO PRINT AGENT

BACKGROUND

In the field of printing, print agent may be applied to a surface by a roller. One printing technology that may employ the use of a roller is liquid electrophotography (LEP). LEP printing involves the transfer of electrically-charged liquid ink via a series of rollers to a substrate.

BRIEF DESCRIPTION OF DRAWINGS

Examples will now be described, by way of non-limiting example, with reference to the accompanying drawings, in which.

DETAILED DESCRIPTION

In a liquid electrophotography (LEP) printing system, print agent, such as ink, may pass through a print agent application assembly, such as a binary ink developer (BID). Each BID stores print agent of a particular colour, so an LEP printing system may include, for example, seven BIDs. Print agent from a BID is selectively transferred from a print agent transfer roller—also referred to as a developer roller—of the BID in a layer of substantially uniform thickness to a photoconductive surface, such as a photo imaging plate (PIP). The selective transfer of print agent is achieved through the use of electrically-charged print agent. The entire PIP is charged, then areas representing an image to be printed are discharged. Print agent is transferred to those portions of the PIP that have been discharged. The PIP transfers the print agent to a printing blanket, which subsequently transfers the print agent onto a printable substrate, such as paper. The discharged portions of the PIP represent the portion or portions of a pattern or image in which print agent from the BID is to be applied to the substrate. Print agent that is not transferred from the developer roller to the PIP (i.e. in those areas where the PIP remains charged) remains on the developer roller of the BID, and is removed from the developer roller by components within the BID, as discussed below.

Figure 1:
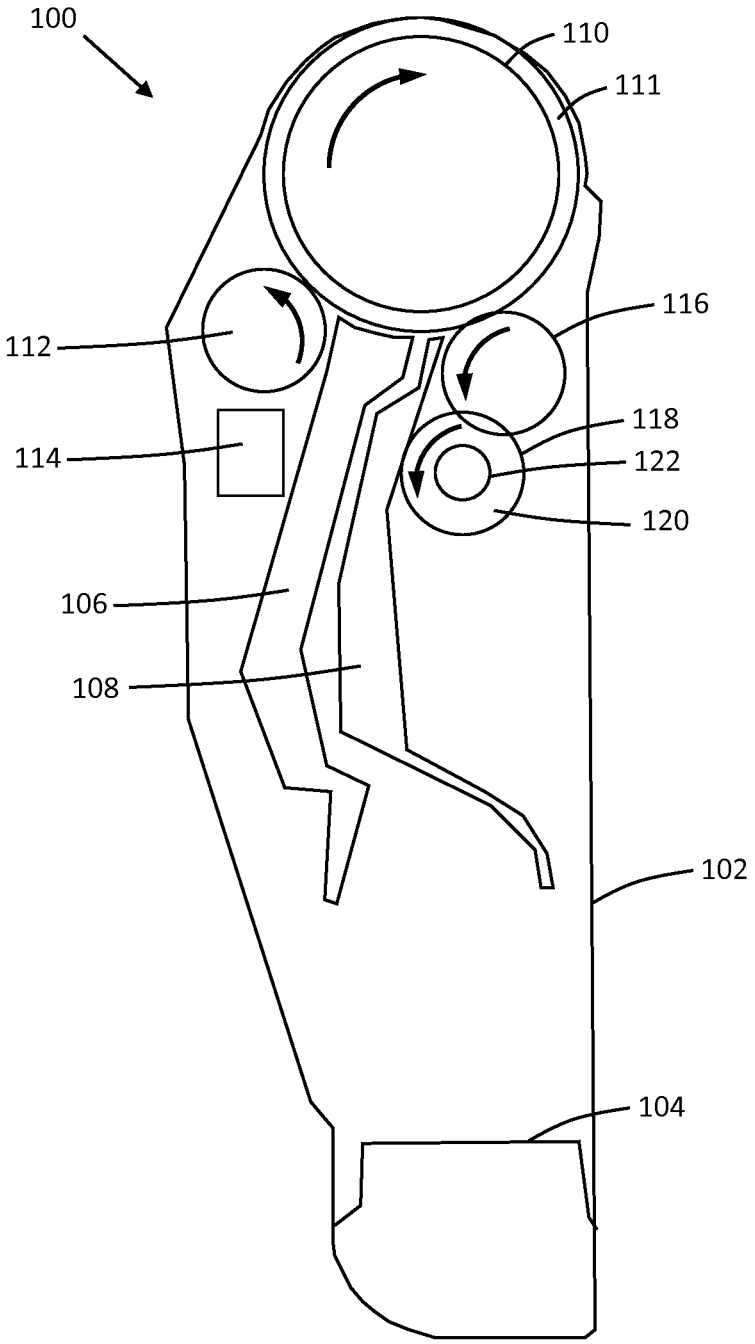
FIG. 1 is a sectional representation of an example of a print agent application assembly.

FIG. 1 is a sectional representation of a print agent application assembly 100. For clarity, some components of the print agent application assembly 100 are not shown in FIG. 1.

The print agent application assembly 100 includes a housing 102 (also referred to as a BID tray) within which other components are at least substantially disposed. An ink tray 104, is formed near to the bottom of the housing 102, to catch unused print agent. The ink tray 104 may be referred to as an ink capture tray. The assembly 100 includes a first electrode 106 and a second electrode 108. Print agent may travel from a print agent reservoir (not shown), which may be located outside the print agent application assembly 100, between the first and second electrodes 106, 108, towards a first roller, referred to as a print agent transfer roller or developer roller 110. The developer roller 110 rotates in a direction shown in FIG. 1. An electric field formed between the first and second electrodes 106, 108 and the developer roller 110 cause print agent to be attracted to the developer roller, to thereby form a film or coating 111 of print agent on the developer roller.

The assembly 100 further includes a second roller, referred to as a print agent regulator roller or squeegee roller 112, which rotates in a direction opposite to the direction of rotation of the developer roller 110, as shown in FIG. 1. The squeegee roller 112 is urged towards the developer roller 110 so as to compact and remove excess liquid from the print agent that coats the developer roller. Further, an electric charge may be applied the squeegee roller 112 to create an electric field between the squeegee roller and the developer roller 110. The electric field causes the print agent to be attracted to a greater extent to the developer roller 110, thereby further compacting the print agent film formed thereon. The effect of the constant mechanical and electric forces applied from the squeegee roller 112 to the developer roller 110 is that the film of print agent on the developer roller is of substantially uniform thickness.

In addition, an oscillating force is applied to the developer roller 110 as it rotates, as discussed below. Specifically, an oscillating force is applied towards print agent disposed on the developer roller 110. The oscillating force serves to further compact the print agent film on the developer roller 110, and improve the uniformity of the film thickness. A mechanism 114 is provided in the print agent application assembly 100, to generate the oscillating force to be applied to the developer roller 110. The mechanism 106 may be associated with the squeegee roller 112 and/or with the developer roller 110. In addition to print agent being compacted by the squeegee roller 112 by the force resulting from being urged towards the developer roller 110, print agent on the developer roller may be further compacted by the oscillating forced applied by the mechanism. Print agent on the developer roller 110 is selectively transferred to a selectively charged photoconductive surface, or photo imaging plate (not shown), and subsequently to a printing blanket for transfer onto a substrate, as described above.

As explained below, the oscillating force may be applied to the developer roller in various forms, and by various components. In some examples, multiple forces may be applied. For example, the oscillating force may comprise an oscillating mechanical force and/or an oscillating electric force. An oscillating mechanical force may be applied by the squeegee roller in a manner described below. An oscillating electric force may be applied by the squeegee roller and/or by a different component, such as either or both of the first and second electrodes.

Print agent that is not transferred from the developer roller 110 to the photo imaging plate is referred to as unused print agent. A cleaner roller 116 is disposed within the assembly 100 adjacent to the developer roller 110, and rotates in a direction opposite to the direction of rotation of the developer roller 110, as shown in FIG. 1. The cleaner roller 116 is electrically charged and attracts electrically-charged print agent, thereby cleaning unused print agent from the developer roller 110.

The assembly 110 also includes a sponge roller 118, which includes an absorbent material 120, such as a sponge, mounted around a core 122. The sponge roller 118 rotates in the same direction as the cleaner roller, as shown in FIG. 1. The sponge roller 118 is mounted adjacent to the cleaner roller, such that, as the sponge roller rotates, the absorbent material 120 absorbs the unused print agent from the surface of the cleaner roller. The absorbent material 120 of the sponge roller has a number of open cells, or pores, for absorbing liquid, such as the unused print agent. In some examples, the absorbent material 120 may be open-cell polyurethane foam. Print agent (e.g. unused print agent captured in the ink tray 104) may be drained from the ink tray and returned to the print agent reservoir.

Figure 2:
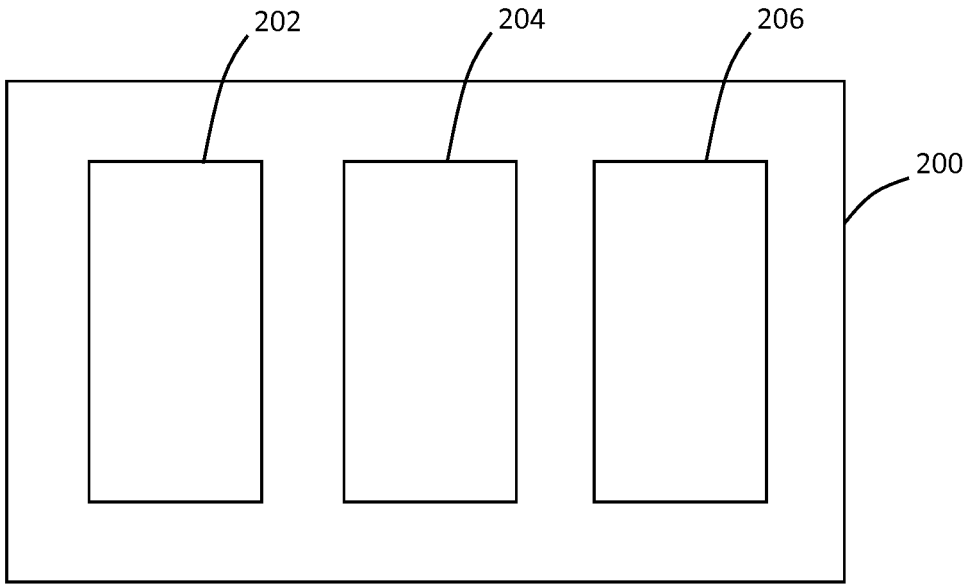
FIG. 2 is a schematic illustration of an example of a print agent application assembly.

FIG. 2 is a schematic illustration of an example of a print agent application assembly 200. The print agent application assembly 200 may comprise the print agent application assembly 100 shown in FIG. 1. The print agent application assembly 200 includes a print agent transfer roller 202 to receive print agent and transfer a portion of the print agent to a photoconductive surface (not shown). The print agent application assembly 200 also includes a print agent regulator roller 204 to regulate a film thickness of print agent on the print agent transfer roller 202. The print agent application assembly 200 also includes a mechanism 206 to generate an oscillating force to be applied to print agent on the print agent transfer roller 202.

As discussed below, the mechanism 206 may be any suitable mechanism capable of generating an oscillating force and/or capable of causing the print agent regulator roller 204 to impart an oscillating force to the print agent transfer roller 202 or to print agent disposed on the print agent transfer roller. The oscillating force may assist with compacting the print agent disposed on the print agent transfer roller 202, and with removing excess liquid from the print agent disposed on developer roller. The oscillating force may also cause print agent to better adhere to the print agent transfer roller. The oscillating force may also cause print agent to be disposed on the print agent transfer roller in a more uniform manner (e.g. with a more uniform thickness).

The oscillating force to be applied to the print agent transfer roller 202 may be a mechanical force or an electric force. In some examples, the mechanism 206 may cause the print agent regulator roller 204 to apply both a mechanical force and an electric force to the print agent transfer roller 202, either simultaneously, in an alternating manner, or in some other way. The mechanism 206 may, in some examples, generate the oscillating force (e.g. a mechanical and/or an electric force) and cause the print agent regulator roller 204 to apply the oscillating force to the print agent transfer roller 202.

In some examples, the mechanism 206 may be to cause the print agent regulator roller 204 to apply an oscillating mechanical force to print agent on the print agent transfer roller 202. For example, the mechanism 206 may cause the print agent regulator roller 204 to vibrate.

The mechanism 206 may, in some examples, comprise a device capable of vibrating the print agent regulator roller 204 such that the print agent regulator roller oscillates relative to the print agent transfer roller 202. In some examples, the vibration may cause the print agent regulator roller 204 to move in a direction directly towards and away from the print agent transfer roller 202 while, in other examples, the vibration may cause the print agent regulator roller to move in some other way, for example in a circular path. The vibration caused by the mechanism 206 may, in some examples, cause the print agent regulator roller 204 to vibrate, or oscillate, at a frequency of around 40 kHz. In other examples, the vibration may be at a lower or higher rate.

The mechanism 206 may comprise a piezo-resistive device. Such a device may generate a suitable vibratory force to cause the print agent regulator roller 204 to vibrate relative to the print agent transfer roller 202 to achieve the application of an intended oscillatory force to print agent disposed on the print agent transfer roller. The mechanism 206 may further comprise or be associated with and coupled to a signal generator (not shown). The signal generator may generate a signal to be used by the mechanism 206 (e.g. by the piezo-resistive device) to create the vibration.

The mechanism 206 may be coupled to the print agent regulator roller 204 in any manner suitable for effecting a vibration in the print agent regulator roller. For example, the mechanism may be coupled to ends of a core of the print agent regulator roller.

In some examples, the mechanism 206 may be to generate an oscillating electric force to print agent on the print agent transfer roller 202. The oscillating force may be applied by creating an oscillating electric field between the print agent regulator roller 204 and the print agent transfer roller 202, and/or between print agent transfer roller 202 and the first electrode 106 and/or the second electrode 108. In other words, the mechanism 206 may cause an electrical field between the print agent transfer roller 202 and the print agent regulator roller 204 and/or one or both of the electrodes 106, 108 to fluctuate between a first level and a second level.

The electric field may be caused to fluctuate between two defined voltages. For example, the electric field may be caused to fluctuate between −500v and −1500v. In other examples, other defined voltages may be used. In some examples, the voltage may be varied between a voltage applied to the print agent transfer roller 202 and a voltage applied to the first electrode 106 and/or the second electrode 108. In some examples, the electric field may be caused to fluctuate between more than two defined voltages. The electric field may fluctuate at a high frequency, and the fluctuation rate may be the same as, or approximately the same as, the fluctuation rate of the mechanical oscillations discussed above. For example, the fluctuation rate may be approximately 40 kHz. In other words, the electric field may be caused to switch between a first voltage and a second voltage a defined number of times in a given time period (e.g. 40,000 times per second).

By fluctuating the electric field between the print agent transfer roller 202 and the print agent regulator roller 204 and/or the electrode(s) 106, 108, an oscillating electric force is applied to the print agent transfer roller. In effect, a pulsed electric force is applied to the print agent, causing charged particles within the print agent to be agitated and settle into a more uniform and compact film on the print agent transfer roller 202.

Thus, in some examples, the mechanism 206 may comprise an alternating current signal generator. The mechanism 206 may itself comprise a source (e.g. a voltage source) to generate the alternating current. In some examples, the print agent application assembly 100 may comprise a separate current source for supplying a current to the print agent regulator roller. A signal generator set to an intended frequency may be provided to cause an alternating current (i.e. an oscillating field) to be generated and supplied to the print agent regulator roller 204 and/or to the electrode(s) 106, 108.

Figure 3:
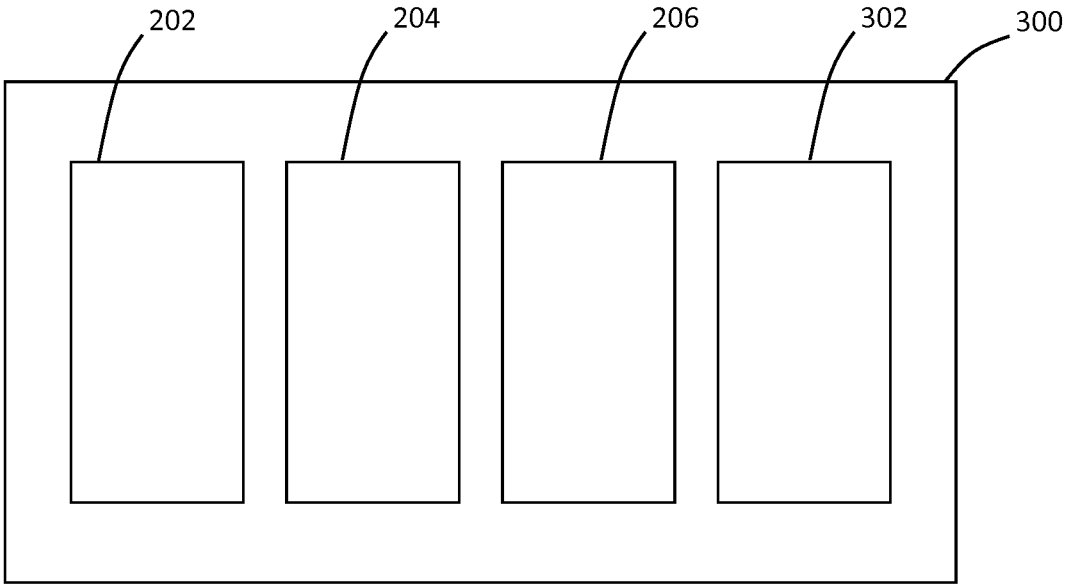
FIG. 3 is a schematic illustration of a further example of a print agent application assembly.

FIG. 3 is a schematic illustration of a further example of a print agent application assembly 300. The print agent application assembly 300 comprises the print agent transfer roller 202, the print agent regulator roller 204 and the mechanism 206 shown in FIG. 2. The print agent application assembly 300 may comprise an electrode 302 to provide an electric charge to the print agent transfer roller 202. In some examples, the print agent application assembly 300 may comprise multiple electrodes. The electrode(s) 302 may comprise one or both of the first electrode 106 and the second electrode 108. The electrode 302 creates an electric field to cause electrically-charged print agent to be attracted to the print agent transfer roller 202. The electrode or electrodes may serve to guide electrically-charged print agent towards the print agent transfer roller 202. In some examples, a signal generator may cause an alternating current to be provided to the print agent transfer roller 202 from the electrode, or from both electrodes 106, 108. In other words, the oscillating force may be applied to the print agent transfer roller 202 by one or both of the electrodes 106, 108.

Whether the mechanism 206 applies an oscillating mechanical force or an oscillating electric force to the print agent transfer roller 202, the mechanism may, in some examples, cause the print agent regulator roller 204 to apply an oscillating force to print agent on the print agent transfer roller 202 at an oscillation frequency of up to around 40 kHz.

In some examples, the mechanism 206 may be to cause the print agent regulator roller 204 to apply both an oscillating mechanical force and an oscillating electric force to print agent on the print agent transfer roller 202. In such examples, the mechanism 206 may include components to cause the print agent regulator roller 204 to vibrate, thereby applying an oscillating mechanical force to the print agent transfer roller 202, and components to cause an oscillating electric field to be formed between the print agent regulator roller and the print agent transfer roller. In other examples, an oscillating mechanical force may be applied to the print agent transfer roller 202 by the print agent regulator roller 204, while an oscillating electric force may be applied to the print agent transfer roller by another electrically charged component, such as the electrodes 106, 108. Thus, the mechanism 206 may be to cause the print agent regulator roller 204 to apply an oscillating mechanical force to print agent on the print agent transfer roller 202. In some examples, the electrode 302 is to provide an oscillating mechanical force to print agent on the print agent transfer roller 202.

In some of the examples described above, the mechanism 206 may cause the print agent regulator roller 204 to apply the oscillating mechanical force and the oscillating electric force to the print agent transfer roller 202. In such examples, the print agent regulator roller 204 may be supplied with an AC voltage (i.e. alternating voltage) while the electrode(s) 302 apply a DC voltage (i.e. direct voltage) to the print agent transfer roller 202. However, while the oscillating mechanical force may be applied by the print agent regulator roller 204, the oscillating electric force may be applied by another component. In some examples, the oscillating electric force may be applied to the print agent transfer roller 202 by the electrode(s) 302. The electrode(s) 302 may supply an oscillating electric force to the print agent transfer roller 202 while the print agent regulator roller 204 supplies a DC voltage to the print agent transfer roller. In other examples, the print agent regulator roller 204 may be electrically coupled to the electrode(s) such that both the print agent regulator roller and the electrode(s) are to apply an oscillating electric force to the print agent transfer roller.

Figure 4:
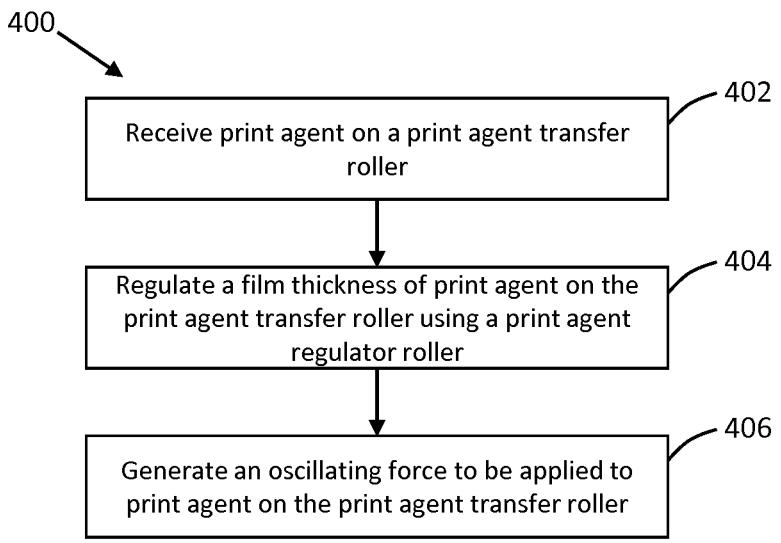
FIG. 4 is a flowchart of an example of a method of applying a force to print agent.

In addition to a print agent application assembly 100, a method of applying a force to a print agent is disclosed. FIG. 4 is a flowchart of an example of a method 400 of applying a force to print agent. The print agent may, for example, be print agent on a print agent transfer roller.

The method 400 comprises, at block 402, receiving print agent on a print agent transfer roller. The print agent transfer roller may comprise the roller 110, 202 discussed above. Print agent may be received on the print agent transfer roller 202 by means of electrodes, such as the electrodes 106, 108, in the manner discussed above. At block 404, the method 400 may comprise regulating a film thickness of print agent on the print agent transfer roller using a print agent regulator roller. The print agent regulator roller may comprise the roller 112, 204 discussed above. The method may comprise, at block 406, generating an oscillating force to be applied to print agent on the print agent transfer roller. The method 400 may be performed using the print agent application assembly 100, 200, 300 discussed above.

The oscillating force to be applied to print agent on the print agent transfer roller may comprise an oscillating mechanical force and/or an oscillating electric force. In some examples, the generating (block 406) may comprise generating an oscillating mechanical force to be applied to print agent on the print agent transfer roller. Such an oscillating mechanical force may be caused, for example, by causing the print agent regulator roller to vibrate relative to the print agent transfer roller. For example, the print agent regulator roller may be causes to vibrate towards and away from the print agent transfer roller as discussed above.

The generating (block 406) may, in some examples, comprise generating an oscillating electric force to be applied to print agent on the print agent transfer roller. Such an oscillating electric force may be caused, for example, by generating an oscillating current (e.g. an alternating current) to be delivered to the print agent disposed on the print agent transfer roller.

In some examples, the generating (block 406) may comprise generating both an oscillating mechanical force and an oscillating electric force to print agent on the print agent transfer roller. In some examples, the oscillating mechanical force may be applied by the print agent regulator roller, while the oscillating electric force may be applied by a different component, such as an electrode. In other examples, both the oscillating mechanical force and the oscillating electric force may be applied by the print agent regulator roller.

Figure 5:
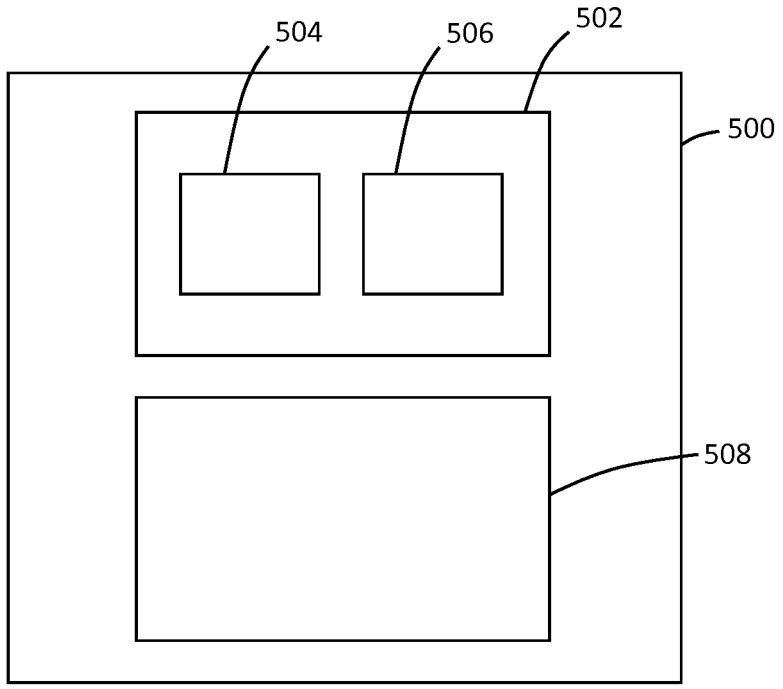
FIG. 5 is a schematic illustration of an example of a print apparatus.

The present disclosure also relates to a print apparatus. FIG. 5 is a schematic illustration of an example of a print apparatus 500. The print apparatus 500 may, for example, comprise an LEP print apparatus. The print apparatus 500 comprises a print agent application assembly 502 having a first roller 504 and a second roller 506. The print agent application assembly 502, or BID, may comprise the assembly 100, 200, 300 discussed above, the first roller 504 may comprise the print agent transfer roller 202, and the second roller 506 may comprise the print agent regulator roller 204 discussed above. The print apparatus 500 further comprises a photoconductive surface 508. The photoconductive surface may, for example, comprise a surface of a photo imaging plate (PIP). The print agent application assembly 502 is to transfer a layer of print agent from the first roller 504 to the photoconductive surface 508. A thickness of the layer of print agent may be controlled by the second roller 506 in the print agent application assembly 502. The second roller 506 is to impart an oscillating force to the first roller 504. As noted above, the oscillating force imparted on the first roller 504 may comprise an oscillating mechanical force, and oscillating electric force, or both. In some examples, a further oscillating force may be imparted on the first roller, either by the second roller, or by another component of the print apparatus 500.

Figure 6:
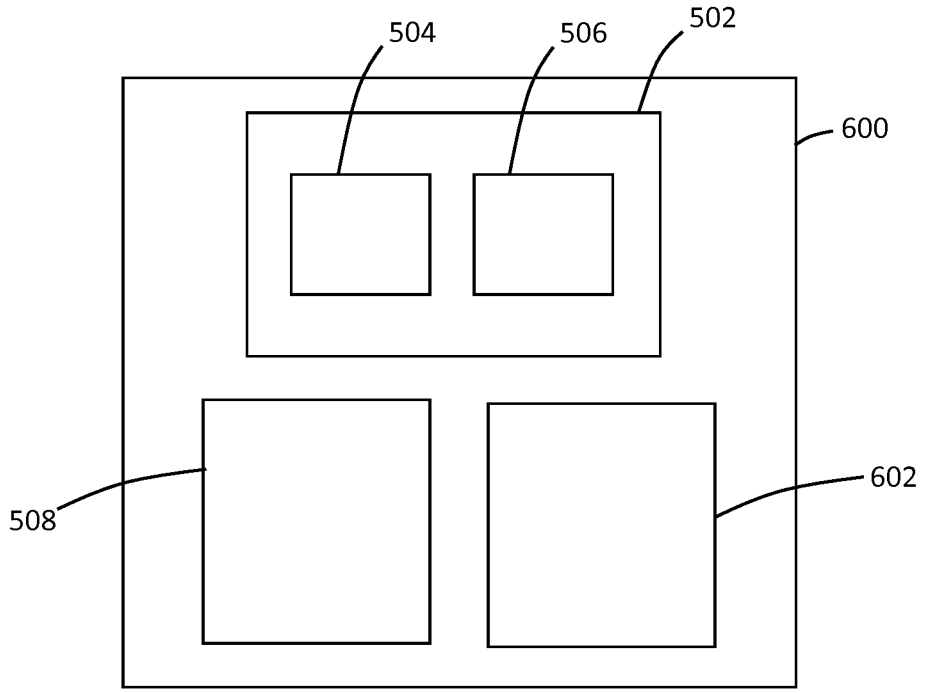
FIG. 6 is a schematic illustration of a further example of a print apparatus.

FIG. 6 is a schematic illustration of a further example of a print apparatus 600. The print apparatus 600 may comprise the assembly 502, the first and second rollers 504, 506, and the photoconductive surface 508 shown in FIG. 5. In addition, the print apparatus 600 may comprise a signal generator 602 coupled to the second roller 506, the signal generator to generate an oscillating signal at a defined frequency. The second roller 506 is to impart an oscillating force to the first roller at the defined frequency. In some examples, the defined frequency may be around 40 kHz, which in other examples, the defined frequency may be lower or higher.

An effect of the print agent application assembly, the method and the print apparatus described above is that a layer, or film, of print agent disposed on a roller to be selectively transferred onto a photoconductive surface is subjected to an oscillating force (mechanical, electrical or both), which may cause the print agent film to be compacted to a greater extent, and to be distributed more uniformly on the roller. Consequently, when the print agent is transferred from the photoconductive surface onto a printable medium or substrate, a number defects, which might ultimately manifest themselves as print defects, may be reduced.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart.

While the method, apparatus and related aspects have been described with reference to certain examples, various modifications, changes, omissions, and substitutions can be made without departing from the spirit of the present disclosure. It is intended, therefore, that the method, apparatus and related aspects be defined by the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print agent application assembly comprising:

a print agent transfer roller to receive print agent and transfer a portion of the print agent to a photoconductive surface;

a print agent regulator roller to regulate a film thickness of print agent on the print agent transfer roller; and a mechanism to generate an oscillating force to be applied to the print agent transfer roller and print agent on the print agent transfer roller.

2. The print agent application assembly according to claim 1, wherein the mechanism is to cause the print agent regulator roller to apply an oscillating mechanical force to the print agent transfer roller and print agent on the print agent transfer roller.

3. The print agent application assembly according to claim 2, wherein the mechanism is to cause the print agent regulator roller to vibrate to generate the oscillating force to be applied to the print agent transfer roller and print agent on the print agent transfer roller.

4. The print agent application assembly according to claim 2, wherein the mechanism comprises a piezo-resistive device.

5. The print agent application assembly according to claim 1, wherein the mechanism is to generate an oscillating electric force to be applied to the print agent transfer roller and print agent on the print agent transfer roller.

6. The print agent application assembly according to claim 5, wherein the mechanism is to cause the print agent regulator roller to apply the oscillating electric force to the print agent transfer roller and print agent on the print agent transfer roller.

7. The print agent application assembly according to claim 5, wherein the mechanism comprises an alternating current signal generator.

8. The print agent application assembly according to claim 1, further comprising:

an electrode to provide an electric charge to the print agent transfer roller;

wherein the mechanism is to cause the print agent regulator roller to apply an oscillating mechanical force to the print agent transfer roller and print agent on the print agent transfer roller; and wherein the electrode is to provide an oscillating electric force to the print agent transfer roller and print agent on the print agent transfer roller.

9. The print agent application assembly according to claim 1, wherein the mechanism is to generate an oscillating force at an oscillation frequency of up to around 40 kilohertz.

10. The print agent application assembly according to claim 1, wherein the mechanism is to cause the print agent regulator roller to apply both an oscillating mechanical force and an oscillating electric force to the print agent transfer roller and print agent on the print agent transfer roller.

11. A method comprising:

receiving print agent on a print agent transfer roller;

regulating a film thickness of print agent on the print agent transfer roller using a print agent regulator roller; and generating an oscillating force to be applied to the print agent transfer roller and print agent on the print agent transfer roller.

12. The method according to claim 11, wherein said generating the oscillating force comprises generating an oscillating mechanical force to be applied to the print agent transfer roller and print agent on the print agent transfer roller.

13. The method according to claim 11, wherein said generating the oscillating force comprises generating an oscillating electric force to be applied to the print agent transfer roller and print agent on the print agent transfer roller.

14. The method according to claim 11, wherein said generating the oscillating force comprises vibrating the print agent transfer roller to generate the oscillating force to be applied to the print agent transfer roller and print agent on the print agent transfer roller.

15. The method according to claim 11, wherein said generating the oscillating force comprises vibrating the print agent regulator roller to generate the oscillating force to be applied to the print agent transfer roller and print agent on the print agent transfer roller.

16. A print apparatus comprising:

a print agent application assembly having a first roller and a second roller; and a photoconductive surface;

wherein the print agent application assembly is to transfer a layer of print agent from the first roller to the photoconductive surface, wherein a thickness of the layer of print agent is controlled by the second roller in the print agent application assembly; and wherein an oscillating force is to be imparted to the first roller.

17. The print apparatus according to claim 16, further comprising:

a signal generator coupled to the second roller, the signal generator to generate an oscillating signal at a defined frequency;

wherein the second roller is to impart the oscillating force to the first roller at the defined frequency.

18. The print apparatus according to claim 16, wherein the oscillating force comprises an oscillating mechanical force to be imparted to the first roller.

19. The print apparatus according to claim 16, wherein the oscillating force comprises an oscillating electrical force to be imparted to the first roller.

20. The print apparatus according to claim 16, wherein the second roller is to impart the oscillating force to the first roller.

* * * * *